United States Patent [19]

Sainen

[11] Patent Number: 4,476,901

[45] Date of Patent: Oct. 16, 1984

[54] APPARATUS FOR DETECTING WEFT YARN IN JET LOOMS

[75] Inventor: Tsutomu Sainen, Kanazawa, Japan

[73] Assignee: Tsudakoma Corporation, Ishikawa, Japan

[21] Appl. No.: 507,425

[22] Filed: Jun. 23, 1983

[30] Foreign Application Priority Data

Jun. 30, 1982 [JP] Japan ..... 57-114168

[51] Int. Cl.[3] ..... D03D 51/31

[52] U.S. Cl. ..... 139/370.2; 250/561; 340/677

[58] Field of Search ..... 139/336 R, 370.1, 370.2; 250/559, 561; 340/657, 677

[56] References Cited

U.S. PATENT DOCUMENTS

| | | | |
|---|---|---|---|
| 3,608,590 | 9/1971 | Hohener | 139/370.2 |
| 4,023,599 | 5/1977 | Zeleny | 139/370.2 |
| 4,082,119 | 4/1978 | Washine | 139/370.2 |
| 4,178,590 | 12/1979 | Weidmann | 340/677 |
| 4,362,190 | 12/1982 | Arakawa | 139/370.2 |
| 4,365,654 | 12/1982 | Viniczay et al. | 340/677 |
| 4,393,903 | 7/1983 | Ida | 139/370.2 |

*Primary Examiner*—Henry Jaudon

*Attorney, Agent, or Firm*—Flynn, Thiel, Boutell & Tanis

[57] ABSTRACT

Jet looms have feelers for detecting whether a weft yarn has been properly inserted through a warp shed at an end of the warp shed.

Air jet looms have photoelectric feelers the sensitivity of which becomes lowered with time due to dust or fly waste attached to the feelers in operation. Water jet looms incorporate electrode feelers with insulation therebetween tending to be deteriorated due to water applied, and hence the sensitivity of such feelers is also reduced with time.

An apparatus according to the present invention increases the gain of a variable-gain amplifier for amplifying an output signal from the feeler as the level of the output signal is lowered, so that the amplified signal is maintained at a suitable level. The amplifier gain is controlled by detecting the level of the feeler output signal with an automatic gain control circuit, and feeding a signal from the automatic gain control circuit back to the variable-gain amplifier to energize a gain varying element in the variable-gain amplifier dependent on the level of the automatic gain control signal.

5 Claims, 7 Drawing Figures

APPARATUS FOR DETECTING WEFT YARN IN JET LOOMS

BACKGROUND OF THE INVENTION

The present invention relates to an apparatus for detecting whether a weft yarn is inserted in a warp shed in a jet loom such as a water jet loom or an air jet loom, and more particularly to electric adjusting means in such a jet loom for automatically increasing the gain of an amplifier connected to a weft feeler head as the sensitivity of the latter is reduced.

Air jet looms incorporate a photoelectric feeler head for detecting whether a weft yarn is properly inserted in a warp shed. The photoelectric feeler head comprises a light-emitting diode disposed at an end of the warp shed and a phototransistor positioned in confronting relation to the light-emitting diode. Any change in the amount of light from the light-emitting diode to the phototransistor due to an inserted weft yarn is sensed by the photoelectric feeler head to determine whether the weft yarn insertion is proper or not. If a mass of fly waste is accidentally attached to the lens in a light transmission window of the light-emitting diode or the phototransistor, then the detecting sensitivity of the feeler head is lowered dependent on the amount of waste meaterial attached to the lens. One solution has been to increase the feeler head sensitivity in advance to compensate for a sensitivity reduction at a later time. However, signals from the feeler head become saturated during a period in which the feeler head lenses suffer from a relatively small amount of fly waste. A malfunction may also be caused by a mass of fly waste which has just passed through the feeler head. For the reasons described above, it has been difficult for the conventional photoelectric feeler heads to keep a desired degree of weft sensitivity.

The applicant has proposed a weft detection process in which an optimum weft sensitivity is established initially for a feeler head, and a reduction in the level of feeler signals at a later time is detected to thereby give an alarm. This arrangement has allowed the feeler head to operate with fewer malfunctions, but has failed to increase the period of time in which the feeler head remains capable of operating properly.

Water jet looms have an electrode feeler head for detecting whether a weft yarn is inserted properly in a warp shed. The electrode feeler head comprises a pair of electrodes connected to a DC power supply for generating an electric signal when an inserted weft yarn is brought into contact with the electrodes. A problem with the electrode feeler head is that the insulation between the electrodes becomes deteriorated during use and weft yarns cannot be detected with sufficient sensitivity due to a leakage current.

Since both the photoelectric and electrode feeler heads are therefore subjected to a reduction in the weft sensitivity with time, with the result that they fail to detect weft yarns under stable conditions for an extended period of time.

SUMMARY OF THE INVENTION

It is an object of the present invention to enable a photoelectric or electrode feeler head to detect weft yarns over an increased interval of time for stable weft detection regardless of a reduction in the sensitivity of the feeler head.

The above object can be achieved by detecting a reduction in the sensitivity of a weft feeler head and increasing the gain of an amplifier dependent on the detected sensitivity reduction to keep the amplifier gain constant at all times as desired. More specifically, the sensitivity reduction of the weft feeler head is detected by an automatic gain control circuit, which produces an automatic gain control signal when the sensitivity of the feeler head is lowered. The automatic gain control signal is fed back to the amplifier to change the gain thereof. The gain change is effected by a gain controlling transistor in one embodiment and by a plurality of gain adjusting resistors in another embodiment. The transistor is connected to an output terminal of the amplifier and has a base to which the automatic gain control signal is applied. The voltage of the automatic gain control signal thus serves as a bias voltage to change the operating point of the transistor dependent on the automatic gain control signal. The automatic gain control circuit may be in the form of a digital circuit for selecting one of the resistors for connection to the amplifier. The digital automatic gain control circuit allows signals to be processed by a central processing unit. The amplifier may comprise an amplifier circuit and a differential amplifier circuit connected in series with each other. This amplifier circuit and differential amplifier circuit combination is effective in setting up a signal at an optimum level in a desired signal detection period.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
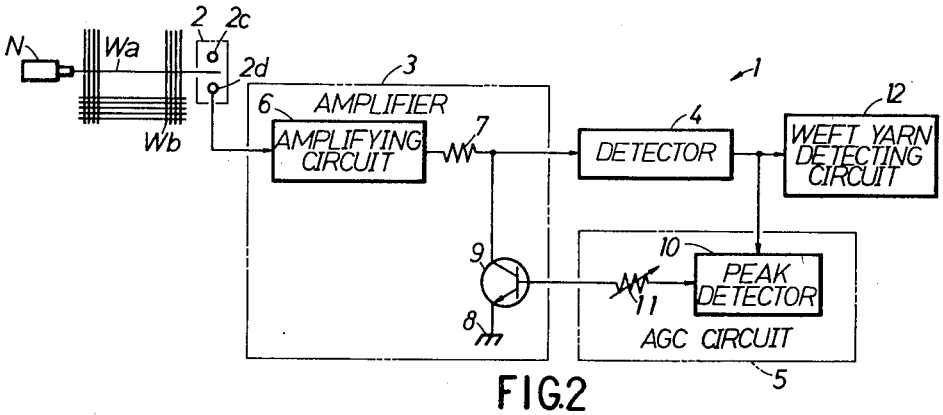
FIG. 1 is a block diagram of a weft yarn detecting apparatus for use with an air jet loom according to the present invention.

As shown in FIG. 1, a weft yarn detecting apparatus 1 for use with an air jet loom comprises a weft feeler head 2, a variable-gain amplifier 3 connected to the weft feeler head 2, a detector 4 coupled to the variable-gain amplifier 3, a weft yarn detecting circuit 12 connected to the detector 4, and an automatic gain control circuit 5 connected between an output terminal of the detector 4 and the variable-gain amplifier 3 for feeding an output signal from the detector 4 back to the variable-gain amplifier 3.

The variable-gain amplifier 3 is composed of an amplifying circuit 6 and a resistor 7 connected in series between the weft feeler head 2 and the detector 4. The variable-gain amplifier 3 also includes a gain controlling NPN transistor 9 having a collector and an emitter connected between a terminal of the resistor 7 connected to the detector 4 and a ground terminal 8. The automatic gain control circuit 5 includes a peak detector 10 and a variable resistor 11 coupled in series between the output terminal of the detector 4 and the base of the transistor 9.

Figure 2:
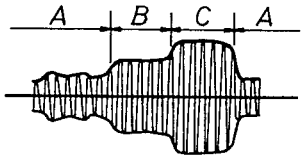
FIG. 2 is a diagram showing the waveform of a weft feeler signal.

The weft feeler head 2 comprises a photoelectric transducer disposed on one side of a warp shed from which an inserted weft yarn emerges. The photoelectric transducer is composed of a light-emitting diode 2*c* and a phototransistor 2*d* spaced therefrom in confronting relation. A weft yarn Wa as inserted by an air nozzle N through a shed of warp threads Wb is detected optically by the weft feeler head 2. The weft feeler head 2 produces a feeler signal having an electric magnitude indicative of whether the weft yarn Wa has reached the feeler head 2 as determined by an amount of light sensed, and issues such a feeler signal to the amplifier 3. As illustrated in FIG. 2, the feeler signal waveform is divided according to signal level into a weft-free period A, weft-detection period B, and a weft-beating period C, the signal having different levels in these periods A, B and C, respectively. The amplifying circuit 6 in the amplifier 3 serves to convert the feeler signal into an AC signal and amplify the AC signal which is delivered through the resistor 7 to the detector 4. The detector 4 converts the supplied signal into a DC signal, which is then applied to the weft yarn detecting circuit 12. The DC signal from the detector 4 is also applied to the peak detector 10 in the automatic gain control circuit 5. The peak detector 10 detects a peak level of the feeler signal during the weft-free period A and produces an automatic gain control signal proportional to the detected peak level. The automatic gain control signal is then applied via the variable resistor 11 to the base of the transistor 9. Since the operating point of the transistor 9 varies with a bias voltage, the gain of the amplifier 3 changes with the signal applied to the base of the transistor 9. As the sensitivity of the photoelectric feeler head 2 is lowered, the level of the output signal from the amplifier 3 is lowered. At this time, the bias voltage impressed on the transistor 9 is reduced by the automatic gain control circuit 5, whereupon the impedance of the transistor 9 is increased and the collector-to-emitter current is reduced. The output signal from the amplifier 3, particularly during the weft-detection period B, is kept at a substantially constant level which is desired.

Figure 3:
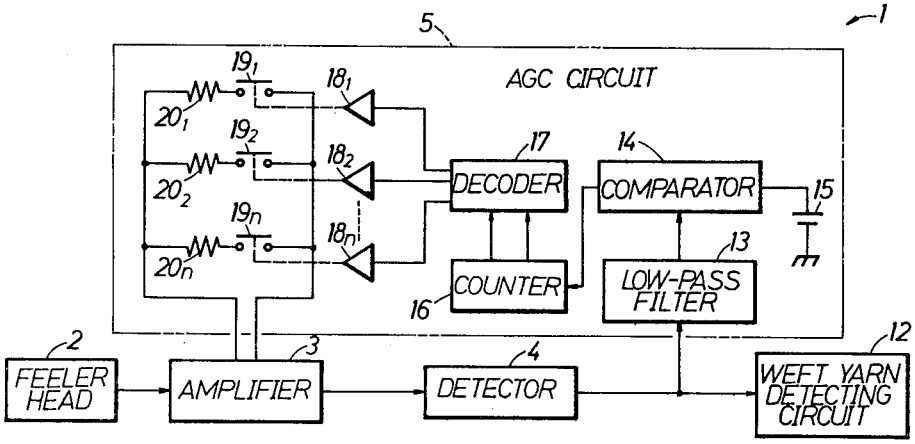
FIGS. 3 and 4 are block diagrams of weft yarn detecting apparatus according to other embodiments of the invention.

FIG. 3 shows an automatic gain control circuit 5 composed of digital circuit components. An output signal from the variable-gain amplifier 3 is converted by the detector 4 into a DC signal, which is fed to the weft yarn detecting circuit 12. At the same time, the DC signal is filtered by a low-pass filter 13 and then fed to a comparator 14 in the automatic gain control circuit 5. The comparator 14 compares an output signal from the low-pass filter 13 with a reference voltage from a reference power supply 15, and produces a digital signal representative of the difference. The digital signal from the comparator is counted by a counter 16 and then demodulated by a decoder 17. The decoder 17 selectively operates driver circuits $18_1$, $18_2$, . . . $18_n$ dependent on the digital quantity of the supplied signal to close a selected one of a plurality of contacts $19_1$, $19_2$, . . . $19_n$. For example, the decoder 17 operates the driver circuit $18_2$ to close the corresponding contact $19_2$. The contacts $19_1$, $19_2$, . . . $19_n$ are connected in series with feedback resistors $20_1$, $20_2$, . . . $20_n$, respectively, which are connected in common to the variable-gain amplifier 3. The resistors $20_1$, $20_2$, . . . $20_n$ serves to change the operating point of the variable-gain amplifier 3 to vary the gain thereof. The output signal from the amplifier 3, that is, the level of the weft yarn signal especially during the weft-detecting period B, is therefore kept substantially constant at a desired level by enabling the gain of the amplifier 3 to be increased as the sensitivity of the weft feeler head 2 is lowered.

Figure 4:
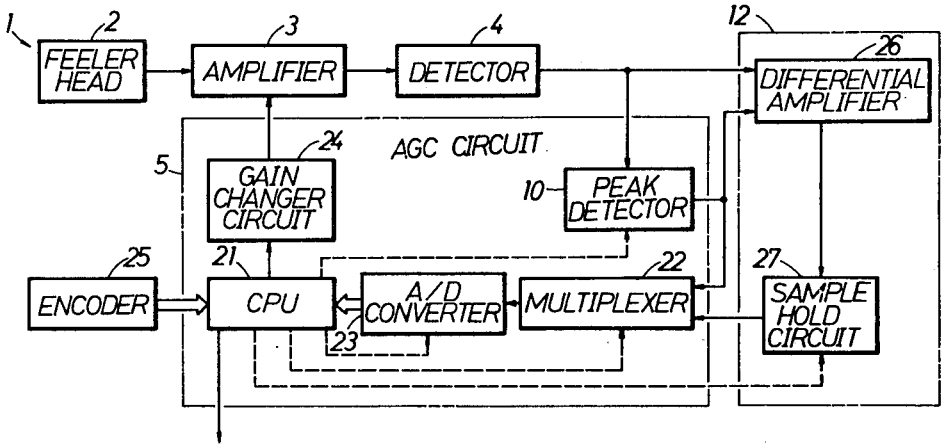

According to still another embodiment shown in FIG. 4, an automatic gain control circuit 5 includes a central processing unit (CPU) 21. An output from a peak detector 10 is switched by a multiplexer 22 and converted by an A/D converter 23 into a corresponding digital signal, which is then applied to the CPU 21. The CPU 21 is operable under a given operation program to compare the output from the peak detector 10 with a stored reference value, and energizes a gain changer circuit 24 based on the result of the comparison to control the gain of the variable-gain amplifier 3. The gain changer circuit 24 is of the same construction as the driver circuits $18_1$, $18_2$, . . . $18_n$, the contacts $19_1$, $19_2$, . . . $19_n$, and the resistors $20_1$, $20_2$, . . . $20_n$. A automatic gain control timing is detected by an encoder 25 in relation to rotation of a main shaft of the loom and is given as an automatic gain control command to the CPU 21. In response to the automatic gain control command, the CPU 21 gets the peak detector 10, the multiplexer 22, and the A/D converter 23 into operation for automatic gain control operation. The encoder 25 also gives a command for determining whether there is a weft yarn in synchronism with rotation of the main shaft of the loom. Such weft yarn determination is carried out by a differential amplifier 26, a sample hold circuit 27, and the CPU 21. More specifically, the differential amplifier 26 serves to amplify the difference between outputs from the detector 4 and the peak detector 10, that is, the signal level in the weft-free period A and the signal level in the weft-detection period B. The sample hold circuit 27 temporarily holds an amplified output from the differential amplifier 26 under a command from the CPU 21. An output from the sample hold circuit 27 is switched by the multiplexer 22 and converted by the A/D converter 23 into a digital signal, which then enters the CPU 21. The CPU 21 compares the differential output from the differential amplifier 26 with a stored reference signal that has been produced when there is a weft yarn as detected by the weft feeler head and produces a stop signal based on the result of comparison thereof. With this embodiment, the CPU 21 is effectively utilized as it performs comparing functions for both the automatic gain control circuit 5 and the weft yarn detecting circuit 12.

Figure 5:
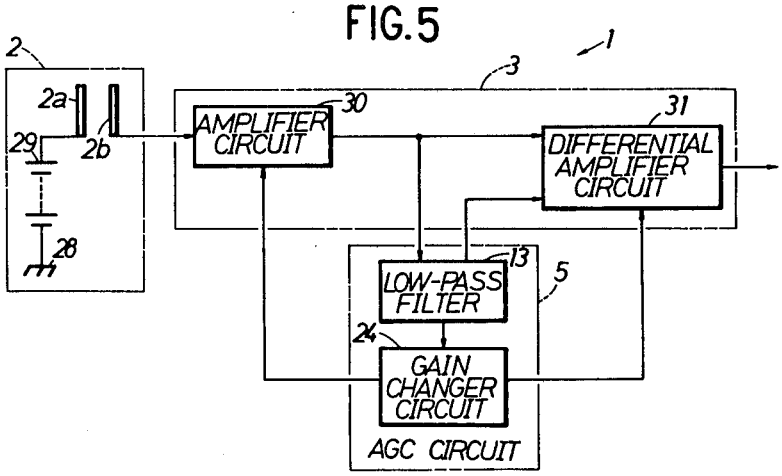
FIG. 5 is a block diagram of a weft yarn detecting apparatus for use with a water jet loom according to a still further embodiment of the invention.
Figure 6:
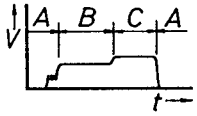
FIGS. 6 and 7 are diagrams illustrative of the waveforms of weft feeler signals.

FIG. 5 shows a weft yarn detecting apparatus 1 for use with a water jet loom. The weft yarn detecting apparatus includes an electrode feeler head 2 composed of a pair of feelers 2*a*, 2*b*, the feeler 2*a* being connected to a DC power supply 29 with one terminal grounded at 28. The feeler 2*b* is connected to a variable-gain amplifier circuit 30 coupled with a differential amplifier circuit 31. The variable-gain amplifier circuit 30 is also connected via a low-pass filter 13 to the differential amplifier circuit 31 and a gain changer circuit 24 having output terminals joined to both the amplifier circuit 30 and the differential amplifier 31. The low-pass filter 13 and the gain changer circuit 24 jointly constitute an automatic gain control circuit 5, and the amplifier circuit 30 and the differential amplifier circuit 31 jointly constitute a variable-gain amplifier 3.

Where the insulation between the electrode feelers 2a, 2b is sufficiently strong, the feeler signal is of substantially zero volt at an initial stage in the weft-free period A as shown in FIG. 6. Even if the gain of the amplifier circuit 30 is selected as being ten times the ordinary gain thereof, and the gain of the differential amplifier circuit 31 is selected as being the same as the ordinary gain thereof, any weft yarn can be detected with sufficient sensitivity because of a large signal level difference between the weft-free period A and the weft-detection period B.

Figure 7:
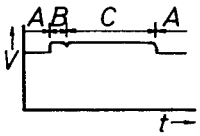

As the insulation between the feelers 2a, 2b is degraded, the leakage current flowing therebetween is increased and the voltage applied between the feelers 2a, 2b is lowered, with the results that the level of the weft signal during the weft-detection period B is reduced, and a DC voltage higher than the zero volt is produced in the weft-free period A. When the gain of the amplifier circuit 30 remains ten times the ordinary gain, any DC component of the feeler signal during the weft-free period A as shown in FIG. 7 is amplified and as a consequence the differential amplifier circuit 31 fails to produce a normal differential output.

Therefore, as the insulation is deteriorated, it is necessary to lower the gain of the amplifier circuit 30 to reduce the amplified DC component, and also necessary to increase the gain of the differential amplifier circuit 31 to pick up an amplified weft signal during the weft-detection period B. The gain changer circuit 24 in the automatic gain control circuit 5 is arranged so as to lower the gain of the amplifier circuit 30 until it is about twice the ordinary gain and to increase the gain of the differential amplifier circuit 31, for thereby increasing the signal level difference until the overall gain of the weft detecting apparatus 1 is about twenty times the ordinary gain. Consequently, a sufficiently large signal level difference can be provided for detecting weft yarns with sufficient sensitivity even when the insulation deterioration has become worse.

Sensitivity reduction in the photoelectric feeler head due to attachment of fly waste or in the electrode feeler head due to insulation deterioration is inherent in textile machines, particularly looms. However, the weft detecting apparatus 1 of the present invention is capable of detecting whether a weft yarn has been inserted through a warp shed without malfunctioning and with high probability even under such sensitivity degradation.

With the arrangement of the present invention, a weft yarn signal can be generated which is of a magnitude large enough to determine whether a weft yarn is present in a warp shed even when the sensitivity of photoelectric and electrode feeler heads is lowered, and hence the interval of time in which any weft yarn can be detected is highly increased. This prevents the loom from operating continuously when no weft yarn is inserted, and increases operation reliability of the weft detecting apparatus.

Although certain preferred embodiments have been shown and described, it should be understood that many changes and modifications may be made therein without departing from the scope of the appended claims.

What is claimed is:

1. An apparatus for detecting a weft yarn in a loom, comprising:

(a) a feeler head for detecting whether a weft yarn has been inserted in a warp shed at an end of the warp shed and for generating an electric feeler signal;

(b) a variable-gain amplifier for amplifying said electric feeler signal; and (c) an automatic gain control circuit for detecting the level of an output signal from said variable-gain amplifier and for feeding an automatic gain control signal proportional to the detected level back to said variable-gain amplifier to change the operating point thereof to thereby control said output signal from said variable-gain amplifier so as to be substantially constant.

2. An apparatus according to claim 1, including a detector connected to an output terminal of said variable-gain amplifier, said variable-gain amplifier comprising an amplifier circuit and a transistor connected to an output terminal of said amplifier circuit, said automatic gain control circuit including a peak detector connected to an output terminal of said detector and having an output terminal coupled to a base of said transistor.

3. An apparatus according to claim 1, including a detector connected to an output terminal of said variable-gain amplifier, said automatic gain control circuit comprising a low-pass filter connected to an output terminal of said detector, a comparator for comparing an output voltage from said low-pass filter with a reference voltage, a counter for counting a digital output signal from said comparator, a decoder and driver circuits for selectively closing a plurality of contacts dependent on a count signal from said counter, and a plurality of resistors each selectively connectable to said variable-gain amplifier by closing a respective said contact selected by said decoder and driver circuits.

4. An apparatus according to claim 1, including a detector connected to an output terminal of said variable-gain amplifier, said automatic gain control circuit comprising a peak detector connected to an output terminal of said detector, a central processing unit operable in synchronism with rotation of a main shaft of the loom for comparing a peak value from said peak detector with a stored reference value, and a switching circuit including a plurality of resistors selectively connectable to said variable-gain amplifier in response to an output from said central processing unit.

5. An apparatus according to claim 1, wherein said feeler head comprises feeler electrodes, said variable-gain amplifier comprising an amplifier circuit connected to one of said feeler electrodes, and a differential amplifier connected to an output terminal of said amplifier circuit and, said automatic gain control circuit comprising a low-pass filter connected to said amplifier circuit and said differential amplifier, and a gain changer circuit connected to said low-pass filter, wherein when said electric feeler signal is lowered in level, said gain changer circuit is operated to lower the gain of said amplifier circuit and increase the gain of said differential amplifier.

* * * * *